US011718980B1

(12) United States Patent
Chandler

(10) Patent No.: US 11,718,980 B1
(45) Date of Patent: Aug. 8, 2023

(54) WATER MANIFOLD FITTING

(71) Applicant: Vista Water Group, LLC, Ashland, OH (US)

(72) Inventor: James W. Chandler, Ashland, OH (US)

(73) Assignee: Vista Water Group, LLC, Ashland, OH (US)

( * ) Notice: Subject to any disclaimer, the term of this patent is extended or adjusted under 35 U.S.C. 154(b) by 0 days.

(21) Appl. No.: 18/051,695

(22) Filed: Nov. 1, 2022

Related U.S. Application Data

(63) Continuation of application No. 16/519,200, filed on Jul. 23, 2019, now Pat. No. 11,492,789, which is a continuation-in-part of application No. 15/351,543, filed on Nov. 15, 2016, now abandoned.

(60) Provisional application No. 62/256,917, filed on Nov. 18, 2015.

(51) Int. Cl.
*E03C 1/122* (2006.01)
*E03C 1/182* (2006.01)
*E03C 1/284* (2006.01)

(52) U.S. Cl.
CPC ..... *E03C 1/1222* (2013.01); *E03C 1/182* (2013.01); *E03C 1/284* (2013.01)

(58) Field of Classification Search
CPC ..... E03C 1/1222
USPC ..... 285/122.1, 125.1, 129.1
See application file for complete search history.

(56) References Cited

U.S. PATENT DOCUMENTS

2015/0315773 A1* 11/2015 Mullaney ..... B29C 64/386 285/125.1

FOREIGN PATENT DOCUMENTS

WO WO-2014094060 A1 * 6/2014 ..... B29C 64/386

OTHER PUBLICATIONS

Notice of Allowance U.S. Appl. No. 17/375,852, dated Dec. 15, 2022.

* cited by examiner

*Primary Examiner* — Lori L Baker
(74) *Attorney, Agent, or Firm* — Ralph E. Jocke; Walker & Jocke

(57) ABSTRACT

An apparatus includes a manifold heat exchange fitting (32) configured to collect a plurality of fluid streams of fluids having different fluid densities. The fitting includes a body (52) with a generally open fluid collection interior area (56). The body of the heat exchange fitting is positioned in a central fluid path that includes a body inlet (58) and a body outlet (60). A plurality of fluid stream fitting openings (76) in the body are connectable to fluid streams of fluids having different densities delivered from water discharge devices such as an autoclave, a steam sterilizer in the steam cooler. The fluid streams of the fluids having different densities collected in fluid communication in the fluid collection interior area may undergo heat exchange prior to discharge from the body outlet.

24 Claims, 15 Drawing Sheets

WATER MANIFOLD FITTING

TECHNICAL FIELD

Exemplary arrangements described herein relate to heat exchange between fluids of different densities. Exemplary arrangements relate to a system that includes a fluid collector that receives fluids of different densities and provides heat exchange between the fluids.

BACKGROUND

In commercial process environments there are often devices that generate fluids having different densities, due to different temperature and pressure properties that are developed in the particular system or device in which the fluid is used. Often the fluid is at a high temperature and the device outputs a fluid stream that includes material in both the liquid and vapor phase. Other fluids in fluid streams from devices may be at ambient temperature. Fluid temperature below ambient temperature may be provided from other systems or devices. These fluids which are at various temperatures, densities and physical states must be collected and conducted for disposal or reprocessing.

Systems that provide fluid streams of fluids at different densities which are collected and combined may benefit from improvements.

SUMMARY

The example arrangements described herein relate to apparatus and systems that include a collector within a flow path which receives fluid streams at different densities. The fluid streams are combined in a collector which comprises a manifold heat exchange fitting. A fluid stream that enters the heat exchange fitting undergoes heat exchange with the other fluid streams. Fluid streams of mixed vapor and liquid are condensed through the heat exchange process and are collected within the body of the heat exchange fitting for communication to an appropriate flow path conduit such as a waste disposal drain line. Numerous different fluid streams of different fluid densities that originate from different devices and systems may be collected for purposes of combination and heat exchange in exemplary arrangements.

DETAILED DESCRIPTION OF EXEMPLARY EMBODIMENTS

Figure 1:
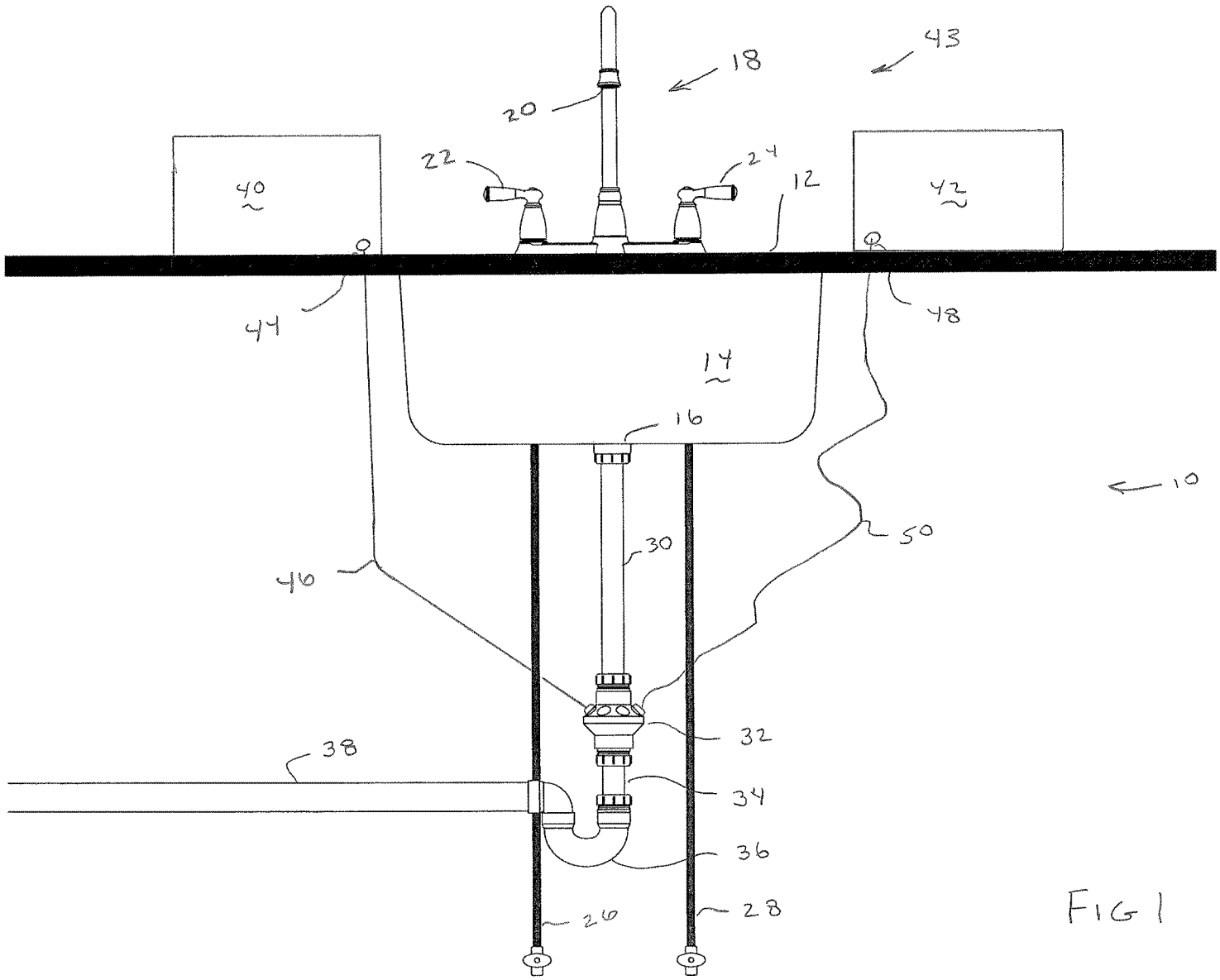
FIG. 1 is a schematic view showing an example system including a collector in the form of a manifold heat exchange fitting that receives fluid streams having different fluid densities.

Referring now to the drawings, and particularly to FIG. 1, there is shown therein a system generally indicated 10. The exemplary system is utilized in a commercial facility that includes devices that produce water waste streams at different fluid densities. The exemplary arrangement includes a sink 12, which includes a water tight holding area or bowl 14. The bowl 14 of the sink includes a drain 16 which is open to atmosphere. The sink is in connection with at least one water faucet 18. The exemplary faucet 18 includes an outlet 20, which is configured to deliver water above and into the sink 12. The exemplary faucet further includes two manually actuated valves 22 and 24. Valves 22 and 24 of the faucet are in connection with and control flow from water supply lines 26 and 28 respectively. Supply lines 26 and 28 correspond to cold water and hot water delivery lines in the exemplary arrangement.

In the exemplary system 10, drain 16 of the sink is connected to a flow path which includes a drain pipe 30. Drain pipe 30 is connected to an exemplary manifold heat exchange fitting 32, which is later discussed in detail. The manifold fitting 32 is connected in the flow path to an outlet pipe 34, which in this example is connected to a liquid holding drain trap 36. In the arrangement shown, the drain trap 36 is a U-shaped trap, which is configured to maintain liquid water therein, even when water has been fully drained from the sink 14. This exemplary configuration of the drain trap 36 provides a pool of cooling water below the fitting and also avoids migration of sewer gas from a drain header 38 to which the trap is connected, up and into the sink through the sink drain. The exemplary U-shaped trap 36 further provides the function of trapping and holding heavy items which may inadvertently pass down through the drain 16 of the sink. It should be understood however, that although in the exemplary embodiment a U-shaped drain trap is utilized, other types of cooling pools and/or drain traps may be utilized in other system configurations.

The exemplary system 10 is representative of systems that may most often be used in clinical facilities. Such clinical facilities may include medical office environments, hospital environments, surgical environments, urgent care centers, veterinary hospital environments or other types of facilities in which multiple devices that produce water streams of different fluid densities may be utilized. Such clinical facilities may include a sterilization center or sterilization room. For example, in exemplary arrangements devices utilized in the clinical facility 43 in the area of the sink may include devices which discharge water streams or other liquid waste material at different densities that is to be disposed of by passing such streams in a flow path down to the drain header 38 for disposal to a sanitary sewer system. For purposes of brevity such discharged water and other liquid waste material whether in liquid or vapor form, are collectively and individually referred to herein as water. The exemplary drain header 38 is in operative connection with a sanitary sewer drain, such as a drain from the particular building in which the system 10 is located. The drain is operatively connected to a municipal or other sanitary waste water system, which provides for the treatment of waste water and other material which is passed in the fluid streams that originate from the drain of the sink and other devices. Of course, it should be understood that this approach is exemplary and in other embodiments other approaches may be used.

Devices which discharge water streams at different densities are represented by devices 40 and 42 in FIG. 1. The water discharge devices used in any exemplary system will depend on the particular system and the clinical, commercial, industrial, residential, medical, dental or other environment in which such devices are used. In some exemplary arrangements, the water discharge devices may also include water connections from one or both of the supply lines 26 and 28. In some exemplary applications the water discharge devices utilized may include devices that are used in connection with sterilizing medical devices, instruments, tools and appliances. Some examples of such devices include autoclaves and steam sterilizers, ultrasonic cleaners, tabletop instrument washers, under counter instrument washers, other item washer devices, model trimmers, reverse osmosis filters, deionization filters, autoclave and steam sterilizer coolers, heat sinks and condensation collection devices, and other devices that discharge a stream of fully or partially liquid water material that is to be disposed of by passing to the drain header 38. The fluid density, temperature and vapor content of the various discharged fluid streams varies depending on the nature and operation of the water discharge device from which the fluid stream originates.

In the exemplary clinical facility embodiment, the water discharge device 40 includes a liquid drain outlet 44, which is connected through a rigid drain line 46 to the fitting 32. Water discharge device 42 has a drain outlet 48, which is connected through a flexible tube 50 to the fitting 32. Of course, it should be understood that the exemplary heat exchange fitting 32 is configured to accept drain lines which provide fluid streams of different types from a plurality of water discharge devices in a manner that is later discussed.

Figure 2:
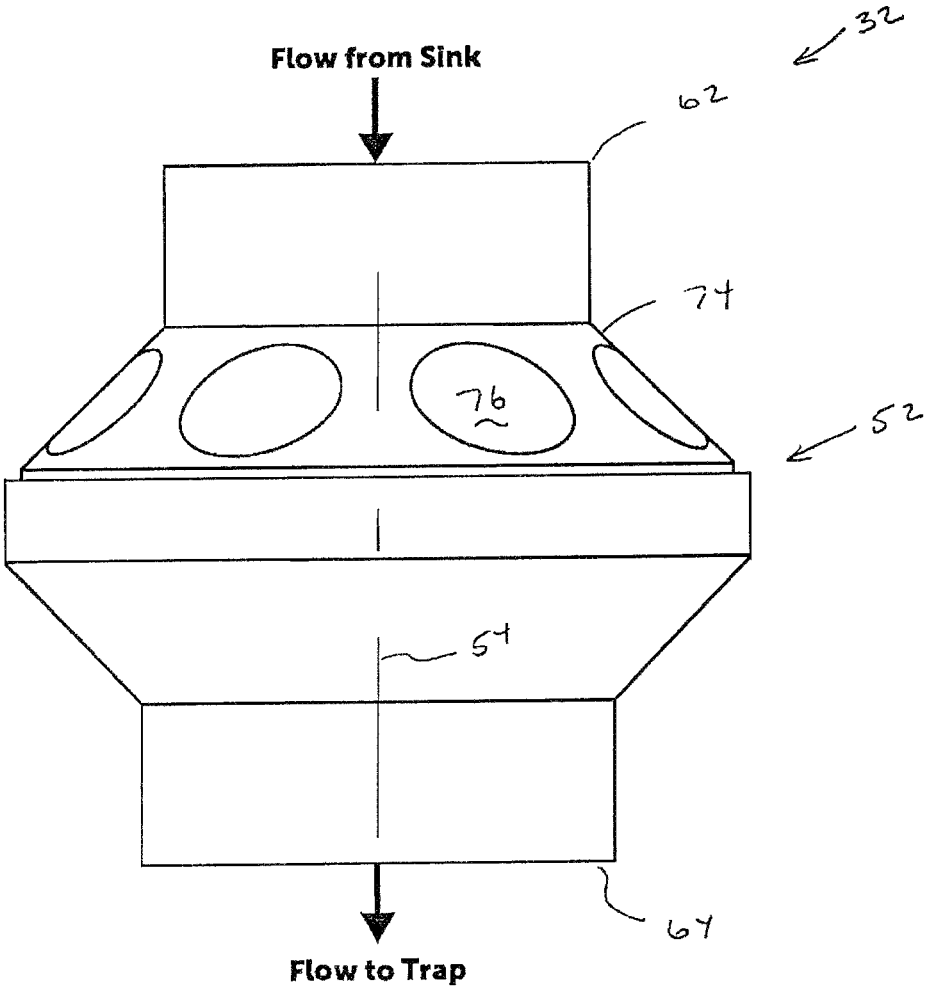
FIG. 2 is a side view of an exemplary manifold heat exchange fitting.
Figure 3:
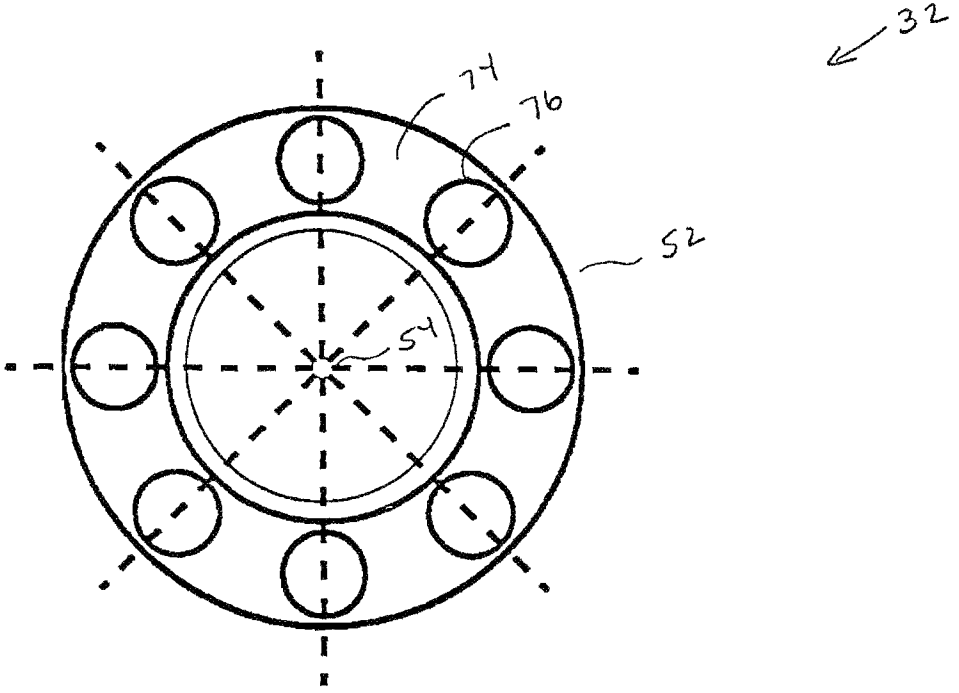
FIG. 3 is a top plan view of the manifold fitting.
Figure 4:
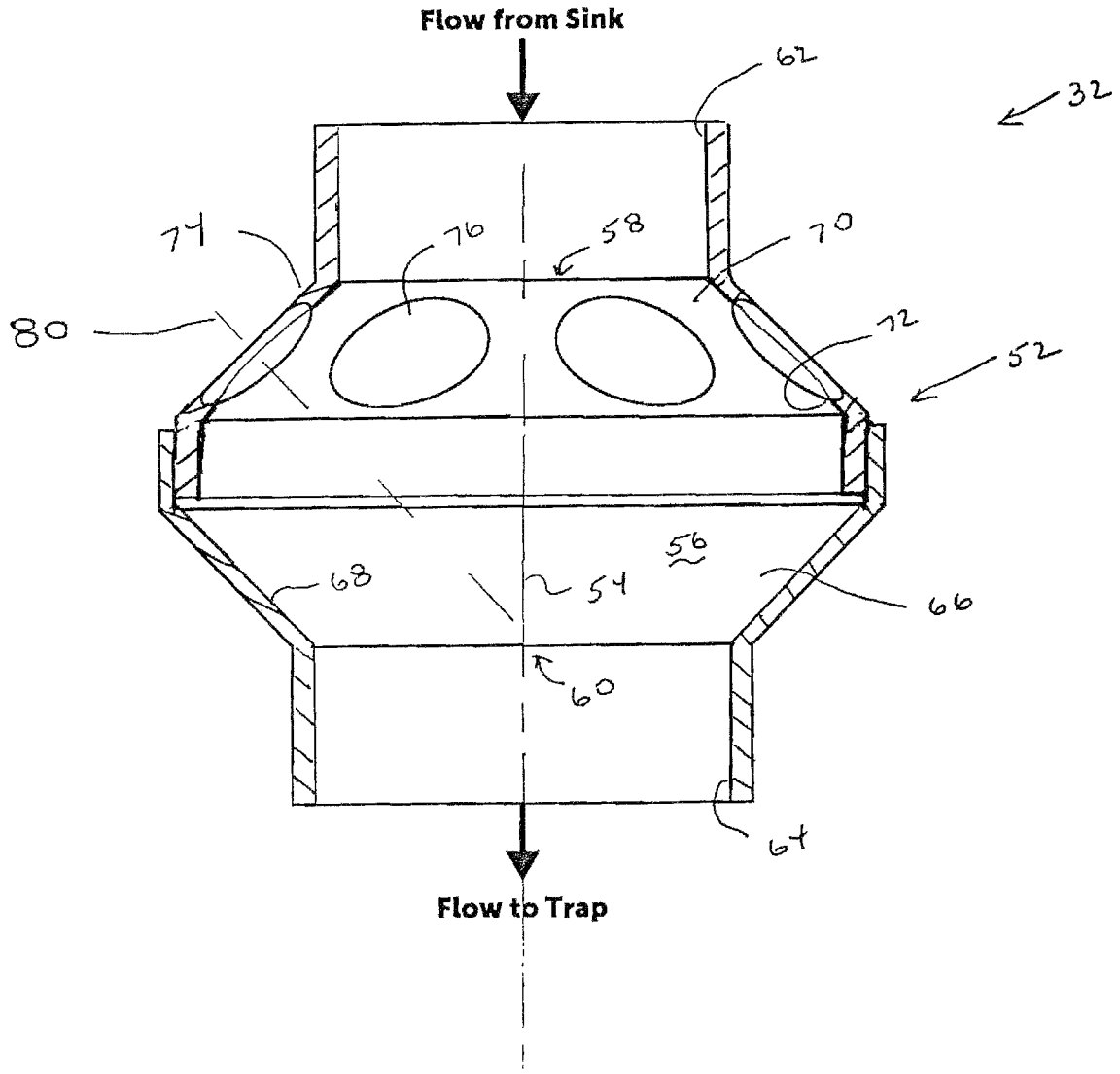
FIG. 4 is an axial cross-sectional view of the exemplary manifold fitting.

An exemplary manifold heat exchange fitting 32 is shown in greater detail in FIGS. 2 through 4. The exemplary fitting 32 serves as a fluid collector and includes an annular body 52. Annular body 52 symmetrically extends along an axis 54. The axis 54 extends in a vertical position in the operative position of the fitting 32. For purposes hereof, the vertical position includes a direct up and down position or a position at an angle from the vertical that enables the fluid streams including water and other liquid waste at different densities to flow from the interior collection area within the body of the fitting to the outlet pipe 34.

In the exemplary embodiment, the body 32 is comprised of a plastic material. Such a plastic material may include plastic such as ABS, PVC, CPVC or Polypropylene. However, in other embodiments, the body may be comprised of metals, such as steel, brass, copper or cast iron. In still other embodiments, the body may be comprised of other materials, such as fiberglass or composites. The material used in any exemplary system will need to provide suitable heat transfer properties and be compatible with the streams of waste material and temperature ranges of the materials in the fluid streams that are collected within the fitting body in the operation of the system.

As shown in FIG. 4, the exemplary fitting body bounds a generally open fluid collection interior area 56. The interior area 56 includes a body inlet 58 and a body outlet 60 which enables positioning the body in a fluid path. Exemplary body inlet 58 is in fluid connection with a fitting inlet coupling portion 62 of the body that in the embodiment shown in FIG. 1 is in operative connection with atmosphere through the sink drain. In the arrangement shown in FIG. 1, the fitting inlet coupling portion 62 is connection with the drain pipe 30. In the arrangement shown in FIG. 1, the fitting inlet coupling portion is operative to receive fluids including water and air from the sink drain 16. Air and vapor are also enabled to be released therethrough. However, as will be seen in other exemplary arrangements, the body inlet coupling portion 62 may only receive or release fluids comprising air and vapor and not liquid material. The fluid collection interior area is referred to as generally open because liquid and air are able to pass therethrough.

The body 52 further includes a fitting outlet coupling portion 64. The fitting outlet coupling portion is configured to receive the liquid that results from the communication of the different fluid streams at different densities in the fluid collection interior area. The fluid streams in communication provide heat transfer within the collector interior area that is sufficient to condense substantially all of the vapor portions of a communicated fluid stream to liquid. The comingled fluid streams which enter the fluid collection area at different densities and temperatures are collectively passed downward from the interior area through the body outlet 60 and delivered as liquid to the outlet pipe 34 as down in FIG. 1.

It should be appreciated that although in the exemplary embodiment the fitting inlet coupling portion 62 and the fitting outlet coupling portion 64 are configured to be fittings that are in fixed attached engagement with adjacent pipe sections, in other arrangements different coupling methods may be utilized to engage the plumbing fitting 32 to adjacent pipes or other structures.

As shown in FIGS. 2 through 4, in the exemplary embodiment of the heat exchange fitting 32 the fluid collection interior area 56 within the body extends annularly and radially outward beyond the circular areas which are occupied by the body inlet 58 and the body outlet 60. The fluid collection interior area 56 further includes an axial end 66. In the operative position, the axial end 66 is the lower end of the interior area. In the exemplary arrangement, the axial end is bounded in the fluid collection interior area by an annular tapered wall surface 68. The annular tapered wall surface is tapered downwardly toward the body outlet 60 in the operative position of the fitting 32. The tapered wall surface is coaxial with the axis 54 and extends to the body outlet. In the exemplary arrangement, the taper is arranged such that the annular tapered wall surface 68 is radially increasingly closer to the axis with increasingly downward axial proximity to the body outlet. Of course, it should be understood that this configuration is exemplary and in other embodiments, other configurations may be used.

The exemplary fluid collection interior area further includes a further axial end 70 that bounds the interior area. The further axial end 70 is disposed at the upper end of the interior area 56 that opposed of the lower end in the operative position of the fitting. The fluid collection interior area at the upper, further axial end is bounded by a further annularly tapered wall surface 72. Annularly tapered wall surface 72 extends radially outward beyond the circular areas occupied by the body inlet 58 and the body outlet 60 as shown. Further, in the exemplary arrangement the tapered wall surface 72 is coaxial with the axis 54 and extends radially increasingly further away from the body inlet and the axis with downward axial proximity to the body outlet.

In the exemplary arrangement, a tapered annular outer wall surface 74 outwardly overlies tapered wall surface 72 and bounds the upper exterior portion of the fluid collection body 52. Like tapered wall surface 72, tapered annular outer wall surface 74 is configured so that its surface is increasingly radially further away from the axis and the body inlet with increasing axial proximity to the body outlet. Of course, it should be understood that this configuration is exemplary and in other manifold fitting arrangements other configurations suitable for the necessary fluid collection, heat exchange and vapor condensation of the communicated plurality of fluid streams may be used.

Figure 12:
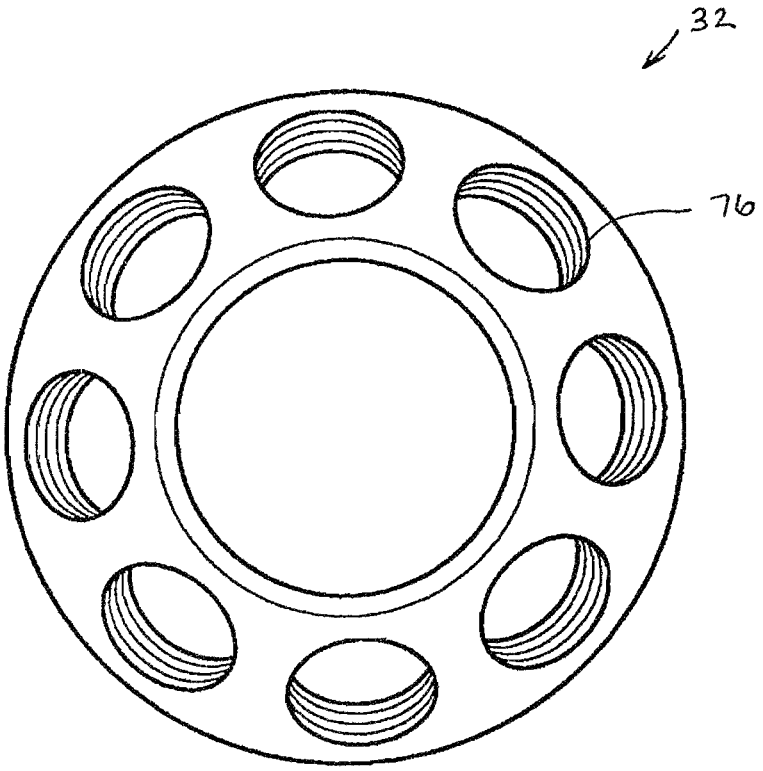
FIG. 12 is a top plan view of an exemplary fitting with eight drain fitting openings.
Figure 13:
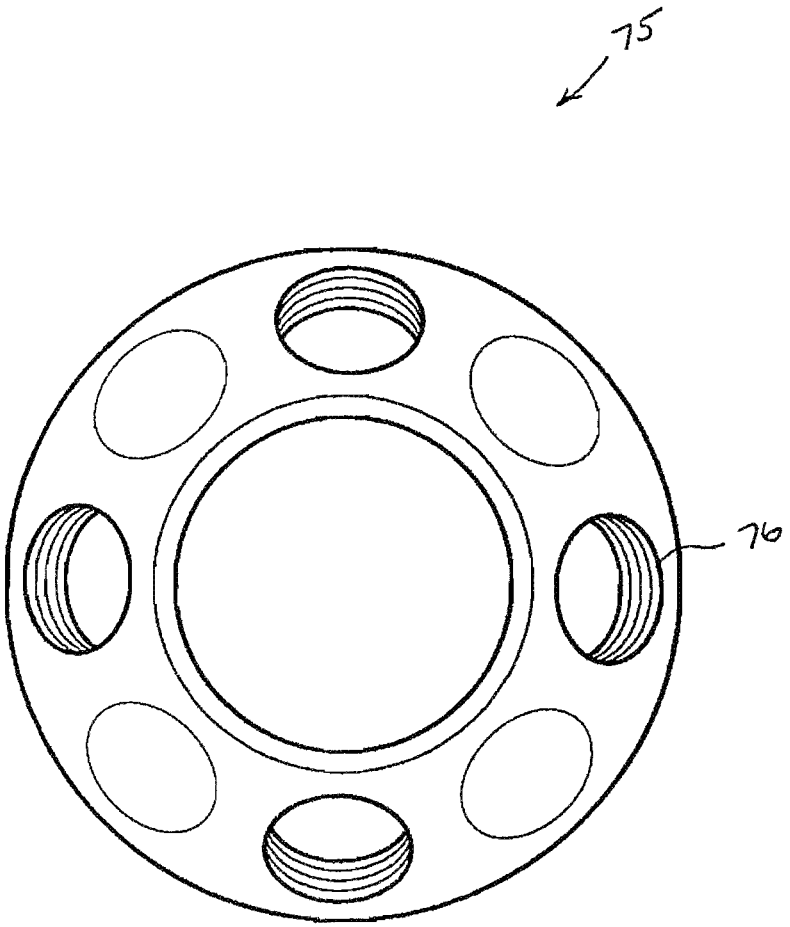
FIG. 13 is a top plan view of an exemplary fitting with four drain fitting openings.
Figure 14:
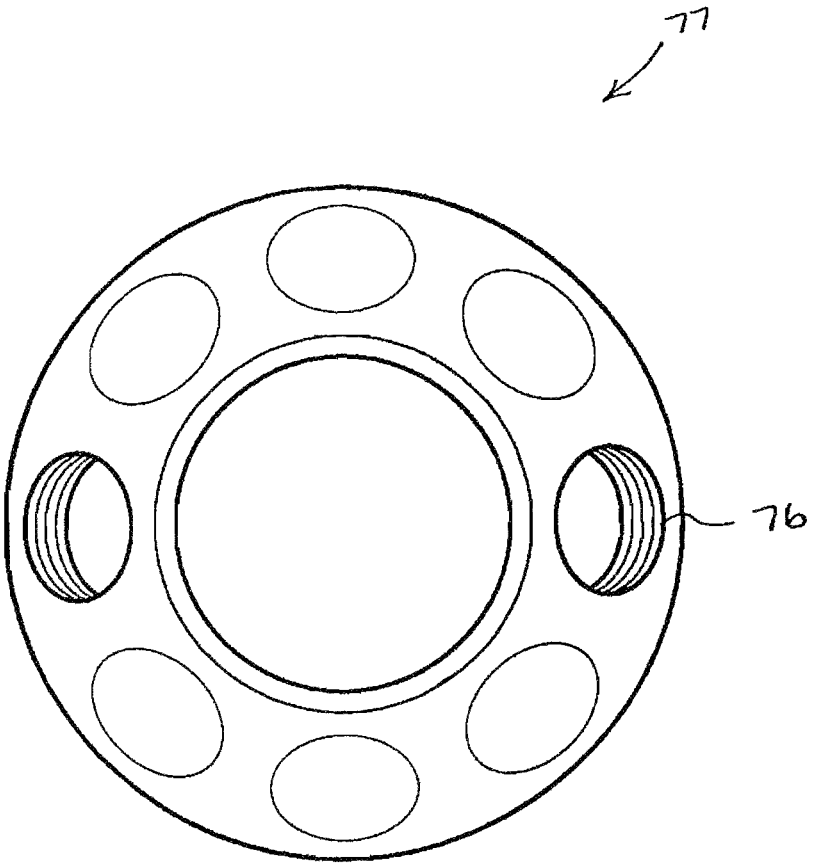
FIG. 14 is a top plan view of an exemplary fitting with two drain fitting openings.

A plurality of fluid stream drain fitting openings 76 extend through wall surfaces 72 and 74 of the body. The plurality of fluid stream drain fitting openings extend into the fluid collection interior area 56 of the fitting body. In an exemplary arrangement, each of the fluid stream drain fitting openings 76 comprises a threaded opening of a common size. In some exemplary arrangements, the drain fitting openings may comprise a one-half inch NPT threaded opening. In one exemplary embodiment of the fitting 32 shown, there are eight drain fitting openings in the body each suitable for receiving a fluid stream in addition to a fluid stream received through the body inlet. A top plan view of fitting 32 with eight fitting openings is shown in FIG. 12. FIG. 13 is a top plan view of an alternative embodiment of a manifold heat exchange fitting 75 with four fluid stream drain fitting openings 76. FIG. 14 is a top plan view of yet another alternative embodiment of a manifold fitting 77 with two fluid stream drain fitting openings 76. Of course, it should be understood that these approaches are exemplary and in other embodiments other types of fluid stream drain fitting connection features and types, opening sizes, numbers and configurations to place the fluid streams of differing fluid densities in communication in the fluid collection interior area may be used.

In the exemplary arrangement, each of the fluid stream drain fitting openings are arranged in a circular pattern about the axis and the body inlet 58, and are uniformly angularly spaced from one another on the tapered annular outer wall surface 74, and each fluid stream drain fitting opening is positioned radially outward of the body inlet. The exemplary fluid stream drain fitting openings 76 extend substantially perpendicular to the wall surface 74 along a fluid stream drain fitting axis 80, one of which is shown in phantom in FIG. 4. Each fluid stream drain fitting axis 80 in the exemplary arrangement intersects the central axis 54 of the manifold heat exchange fitting at an acute angle. Further, in the exemplary arrangement in the operative position of the manifold fitting the fluid stream drain fitting openings 76 are positioned vertically aligned above the annular tapered wall surface 68, which bounds the fluid collection interior area 56 of the body at the lower end of the interior area.

Figure 5:
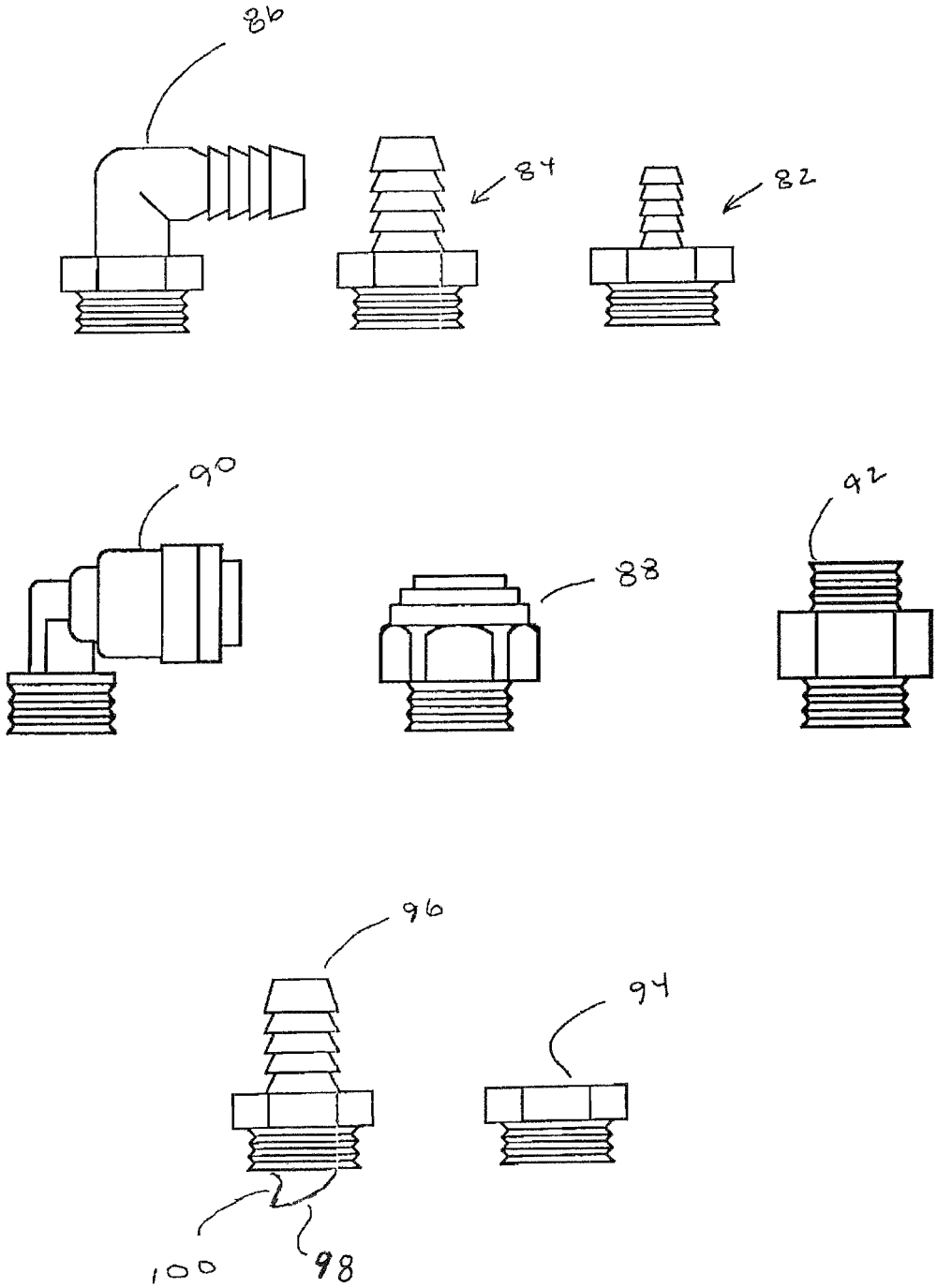
FIG. 5 are side views of a collection of numerous different types of drain fittings that can be used to deliver fluid streams at different densities and that may be engaged with the exemplary manifold fitting.

In the exemplary arrangement, each of the fluid stream drain fitting openings is configured to receive in releasable threaded engagement therewith a drain fitting, which is fluidly connectable with and configured to receive a fluid stream from a corresponding water discharge device. Exemplary fluid stream drain fittings which may be engaged with the exemplary fluid stream fitting openings are shown in FIG. 5. The exemplary fluid stream drain fittings may include suitable hose fittings such as hose barb fittings 82 and 84. Exemplary fittings 82 and 84 are straight hose barb fittings that are suitable for engagement with a flexible conduit that carries a fluid stream, such as a plastic tube or a rubber hose. As represented exemplary fitting 82 is configured to engage a smaller hose or tube than fitting 84. Each of the fittings is configured with a threaded portion having an opening therethrough. The threaded portion is engageable with the threaded fluid stream drain fitting opening 76 in the body of the fitting 32. Of course the size, configuration, material and other aspects of the fluid stream conduit and fitting will depend on the temperature, pressure, flow rate and other properties of the fluid stream.

An exemplary elbow barb fluid stream fitting 86 is shown in FIG. 5. The exemplary elbow barb fitting is generally similar to fittings 82 and 84, in that it accepts a flexible tube thereon. However, elbow fitting 86 is angled relative to the threaded portion so as to accept the tube at a 90 degree angle relative to the main body axis of the manifold manipulated fitting.

Other alternative fittings that may be used in connection with exemplary embodiments include a quick connect male adaptor fluid stream fitting 88. Fitting 88 is configured to accept and engage a plastic tube in aligned engagement therewith. A quick connect elbow fitting 90 is similar to fitting 88, except that it accepts a plastic tube or other conduit therein at a 90 degree angle to the main fitting body.

Other types of fluid stream fittings, such as a threaded adaptor fitting 92 can also be used in some exemplary arrangements. Adaptor fitting 92 can be used for connecting to threaded fittings commonly used with solid conduits, such as brass fittings, which are used to engage copper or brass tubing. Alternatively, threaded fittings for engaging plastic threaded tube fittings, stainless steel tubes and fittings or other types of fluid stream conduits may be used.

It should be understood that the fluid stream fittings shown are exemplary of many different types of fittings that can be used in conjunction with exemplary embodiments of the manifold heat exchange fitting. Further, it should be appreciated that while threaded connections into the fluid collection interior area of the fitting body are shown, in other exemplary arrangements other types of connections for fluid stream fittings may be utilized. These may include for example, cemented type coupling openings included on the body which can be used to connect to cemented pipes or tubing. Further, while the exemplary embodiment shows female coupling openings through the fluid collection body, other configurations of fittings may have male adaptors for connecting to various types of fluid stream conduits that extend externally of the body. The exemplary arrangement may be adapted for use with numerous different types of fluid stream conduits and connectors as appropriate for the particular system environment in which the manifold heat exchange fitting may be utilized.

In the exemplary embodiment of manifold fitting 32, up to eight fluid stream conduits that provide fluid streams at different densities from different water discharge devices may be connected to the fitting through the fluid stream drain fitting openings 76. However, in many system configurations not all of the fluid stream drain fitting openings will be utilized for connection to a respective water discharge device that provides a fluid stream. This may be true even with lesser numbers of openings such as fittings 75 and 77. In exemplary embodiments, the unused fluid stream openings 76 are closed through use of closure members such as plugs. An exemplary plug 94 is shown in FIG. 5. Plug 94 may be threadably engaged with an opening 76 to close the opening when not in use. Thereafter, in the event the configuration of the area changes and an additional fluid stream from a water discharge device needs to be added or needs to be moved to another fluid stream location, plug 94 can be removed from the respective opening and a suitable fluid stream drain fitting may be installed. Of course, it should be understood that this approach facilitates the rearrangement of devices and fluid streams in exemplary system embodiments. Of course, in other embodiments other approaches may be used.

In the operation of the exemplary equipment in the clinical facility 43 shown in the system 10, liquid water that is discharged into the sink from the water outlet 20 of the faucet 18 along with ambient air passes through the drain 16 of the sink 12. The drain water flows as a fluid stream through the drain pipe 30 and through a flow path that extends through the center of the interior area 56 of the fitting 32. The fluid stream including water drained from the sink may provide a cooling effect in the fluid collection interior area of the manifold fitting and provide a liquid film on interior surfaces of the fitting to facilitate condensation of water vapor included on other fluid streams that communicate with the interior area. Liquid in the fluid collection interior area passes out the outlet pipe 34, through the trap 36 and through the drain header 38 to the sanitary sewer.

When one or more of the water discharge devices 40, 42 are operated to provide fluid streams at different fluid densities therefrom, water and/or other waste passes from the respective fluid stream drain outlet 44, 48 and through the respective drain line 46, 50 into a respective fluid stream drain fitting positioned in a respective opening 76 of the manifold fitting 32. The fluid that passes through the fluid stream drain fitting in the opening 76 flows downward within the fluid collection interior area 56 of the body and is comingled with other fluid streams therein. The fluid stream may undergo heat exchange with the other fluid streams to condense vapor and or consolidate atomized particles in the fluid streams. Air that is present within the fluid collection interior area also may serve as a cooling fluid which provides heat exchange to achieve condensation of vapor. Fluid streams which enter the fluid collection interior area at different densities collect as liquid and flow downward to engage the annular tapered wall surface 68. The annular tapered wall surface directs the liquid toward the body outlet 60 and through the fitting outlet coupling to the outlet pipe 34 and pool of water in the trap 36. In the exemplary arrangement, the positioning of the fluid stream outlet openings 76 and the delivery of the fluid streams through the associated drain fittings in overlying relation vertically above the annular tapered wall surface 68 facilitates fluid engagement and heat exchange on the tapered wall surface, and draining the condensed and collected waste water and liquid out of the interior area of the fitting body. Further, in this exemplary arrangement the positioning of the fluid stream outlet openings from the water discharge devices outside the main axial fluid stream flow path axially through the body 52 reduces the risk of the fluid stream drain fittings that are positioned in the openings 76 from becoming clogged with residues, debris or other material.

In addition, in some exemplary arrangements the fluid stream drain fittings utilized in connection with some water discharge devices may include a stream directing outlet, which directs the fluid stream flow in a particular direction within the interior area of the fitting 32. An example of such a drain fitting with a stream directing outlet is fitting 96 shown in FIG. 5. As shown, fitting 96 is similar to the other fluid stream fittings previously discussed, except that it includes a baffle or fin 98, which serves to direct the liquid fluid stream coming from an outlet 100 in a direction that is generally perpendicular to the central axis of the fitting. In the exemplary arrangement, the directing fluid stream outlet directs fluid in a direction that is selected based on the orientation of the fitting as it is installed in connection with the fitting body 52. Further in other exemplary arrangements suitable baffles or fins may be utilized to collect droplets in vapor or atomized water in the fluid stream through impingement. Such baffles or fins may be comprised of suitable heat conductive or heat absorbing materials that provide advantageous heat exchange properties in addition to directing of one or more of the fluid streams.

Due to the NPT connections used in the exemplary embodiment, the fluid stream fittings are enabled to be angularly positioned in the suitable arrangement so as to direct the fluid stream outlet of the fitting within the fluid collection interior area in a desired direction while the threads of the body of the fluid stream fitting remain in fluid tight engagement with the threads bounding the opening 76 in which the fitting is positioned. This enables the direction of the outlet 100 to be positioned as desired within the fluid collection interior area of the body 52. In some exemplary arrangements, directing outlet is configured to cause the fluid stream to pass from the directing outlet 100 in a direction which is radially disposed from and transverse to the axis 54 such that the fluid stream passing from the outlet 100 flows in the interior area to establish a rotational flow within the interior area 56 of the body and around the annular tapered wall surface 68. This may be desirable in some embodiments to provide a disbursing or flushing action to prevent the concentration of material in an area directly below the respective drain outlet opening. It may also be useful in some arrangements to provide mixing of fluid streams and/or heat exchange with the surfaces of the interior area. It may also be useful in some arrangements for avoiding hot liquid material from engaging an area of a body comprised of plastic or other temperature intolerant material consistently in a particular location of the annular tapered wall surface 68 or other collection area location. Of course it should be understood that these approaches are exemplary and in other embodiments other approaches may be used.

In the exemplary embodiment, the fluid collection body 52 of the manifold heat exchange fitting 32 is comprised of a clamshell construction arrangement. This clamshell arrangement includes an upper portion, which includes the fitting inlet coupling portion and the tapered annular upper wall surface 74 with the fluid stream drain fitting openings 76. The clamshell arrangement also includes a lower portion which includes the fitting outlet coupling portion 64 and the annular tapered wall surface 68. This exemplary clamshell arrangement may be utilized for ease of manufacture and may provide for permanent assembly and engagement of the fluid collection body upper and lower portions. However, it should be understood that in other arrangements other configurations may be used. For example, in some arrangements the fluid collection body upper and lower portions may be separable, such as through a threaded, clamped or other releasable connection. The separability of the portions may be useful in some arrangements for purposes of cleaning or inspecting the fluid collection interior area of the device.

Further, in other arrangements the body of the fitting may have other shapes or other locations for the fluid stream drain fitting openings. For example, in some exemplary arrangements the fluid stream drain fitting openings may extend in vertically extending side walls of the body of the manifold fitting. Other body arrangements may also include other configurations and opening arrangements so as to facilitate fitting engagements from multiple directions. Further, as previously discussed, the body may include a plurality of different sizes and types of fluid stream fitting engaging structures and openings so as to facilitate the use of the manifold fitting member in numerous different types of systems. It can be appreciated that numerous different types and configurations of manifold fittings may utilize the principles described herein.

Figure 6:
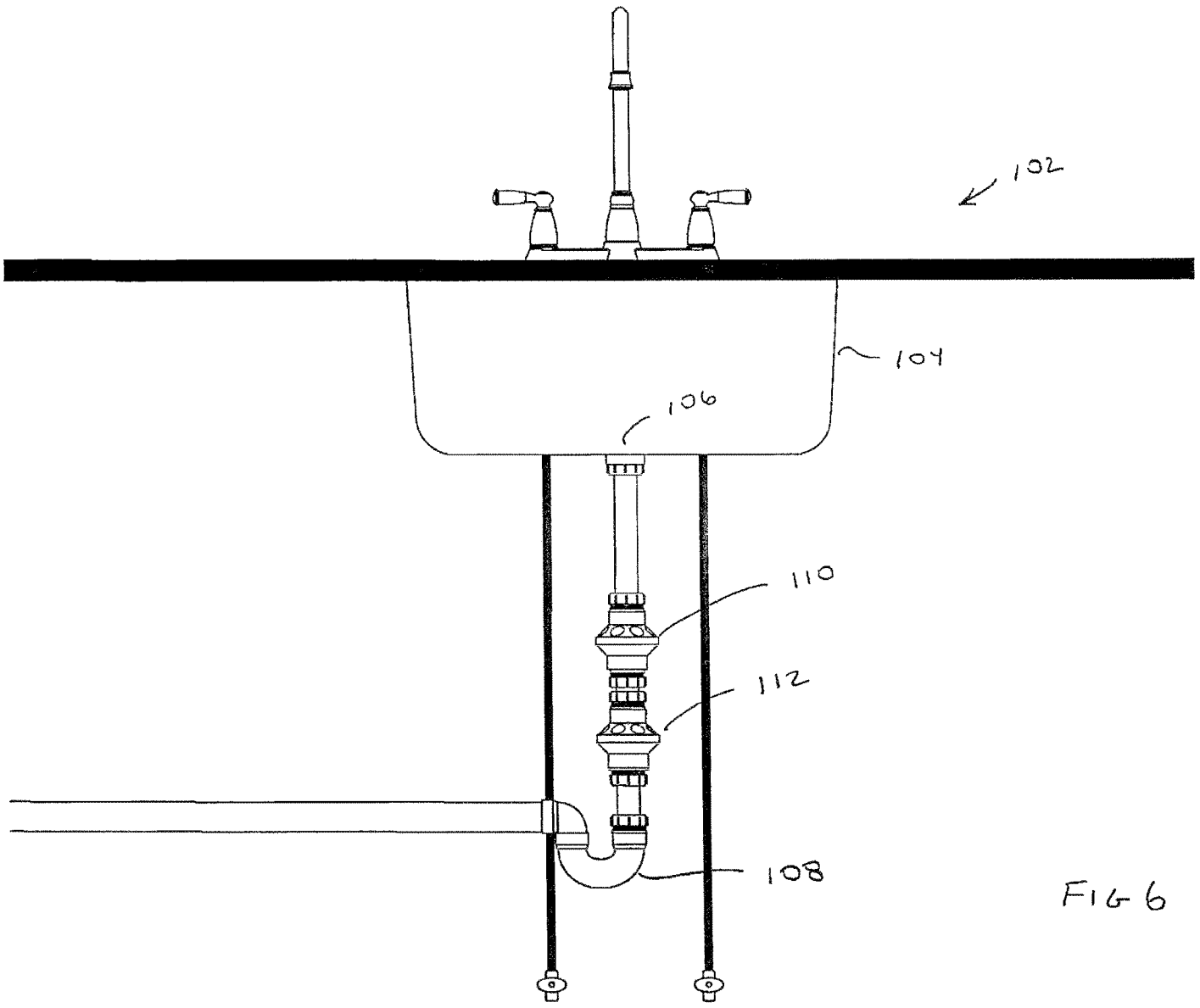
FIG. 6 is a schematic view showing an alternative system arrangement with two manifold heat exchange fittings arranged in a vertically aligned arrangement.

FIGS. 6 through 11 and 15 show alternative arrangements which are representative of ways in which the exemplary manifold heat exchange fittings may be utilized in systems which deliver a plurality of fluid streams of fluids having different densities. For example, FIG. 6 shows a system 102 with a sink 104, including a drain 106. The drain 106 is fluidly connected to a trap 108. In this exemplary arrangement, a first manifold fitting 110 and a second manifold fitting 112 are in aligned vertical relation in a fluid path between the sink drain 106 and the liquid pool holding trap 108. As can be appreciated, each of the manifold fittings 110 and 112 are configured to accept a plurality of fluid stream drain fittings therein. As a result, this configuration provides for a potential doubling of the number of available fluid stream outlets for fluid streams from water discharge devices compared to the system 10 shown in FIG. 1.

Figure 7:
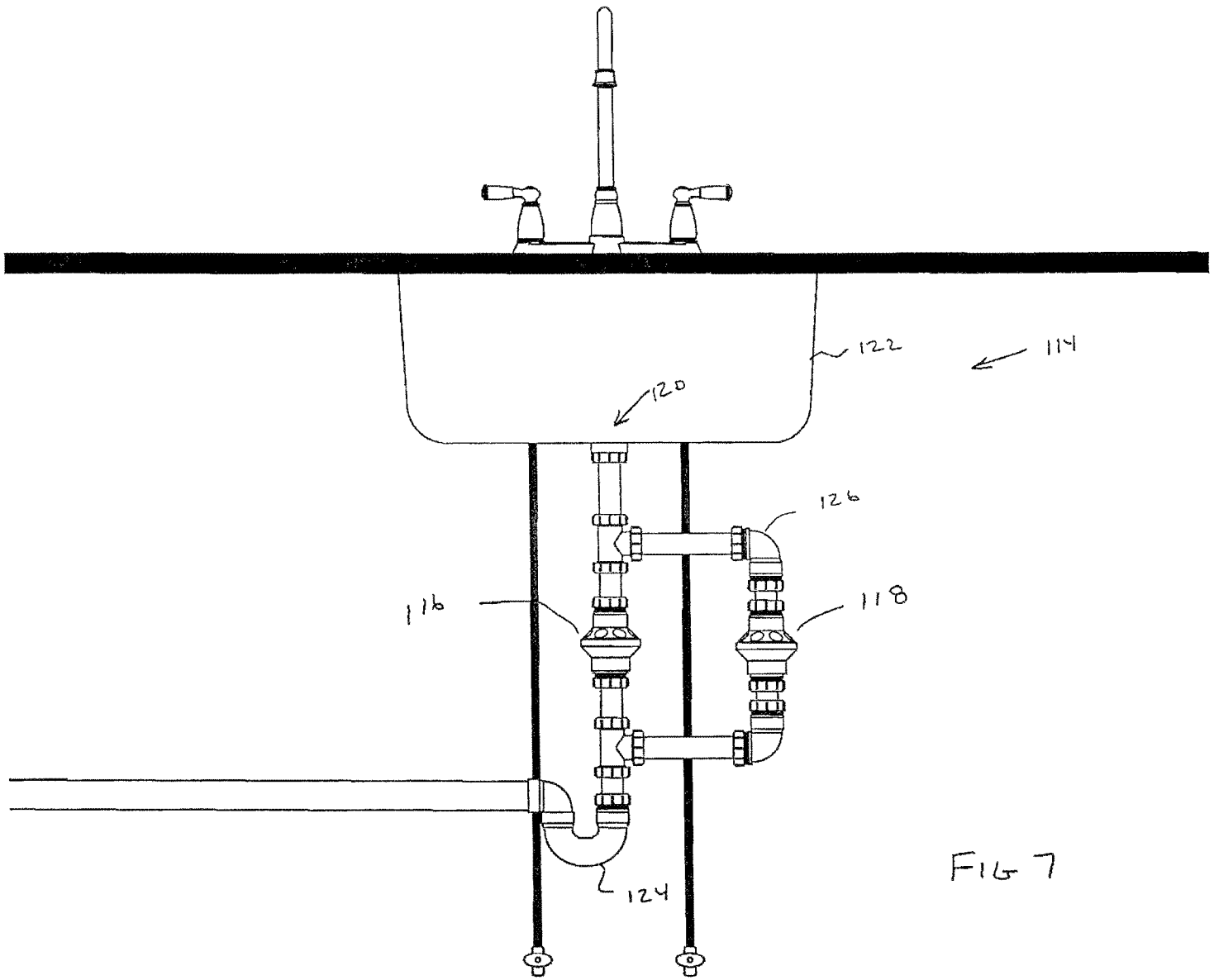
FIG. 7 is a view of an alternative system arrangement with two manifold heat exchange fittings arranged in a side-by-side arrangement.

FIG. 7 shows an alternative exemplary system 114, which also includes a pair of manifold fittings 116 and 118, which are positioned between the drain 120 of a sink 122 and a liquid holding trap 124. In this exemplary arrangement, the manifold fitting 116 is positioned in the vertical fluid path between the sink and the trap, while the manifold fitting 118 is positioned in a branch line 126, which is connected via "T" connections to the main line. It can be appreciated that the arrangement of system 114 enables providing additional fluid stream drain fitting opening positions which are transversely spaced which may facilitate the fluid stream drain line connections for fluids having different densities from the various water discharge devices to the fittings. In addition in some exemplary arrangements fittings 116 and 118 may be comprised of different materials to provide different heat exchange properties or may provide different internal fluid stream mixing to more suitably handle the plurality of received fluid streams.

Figure 9:
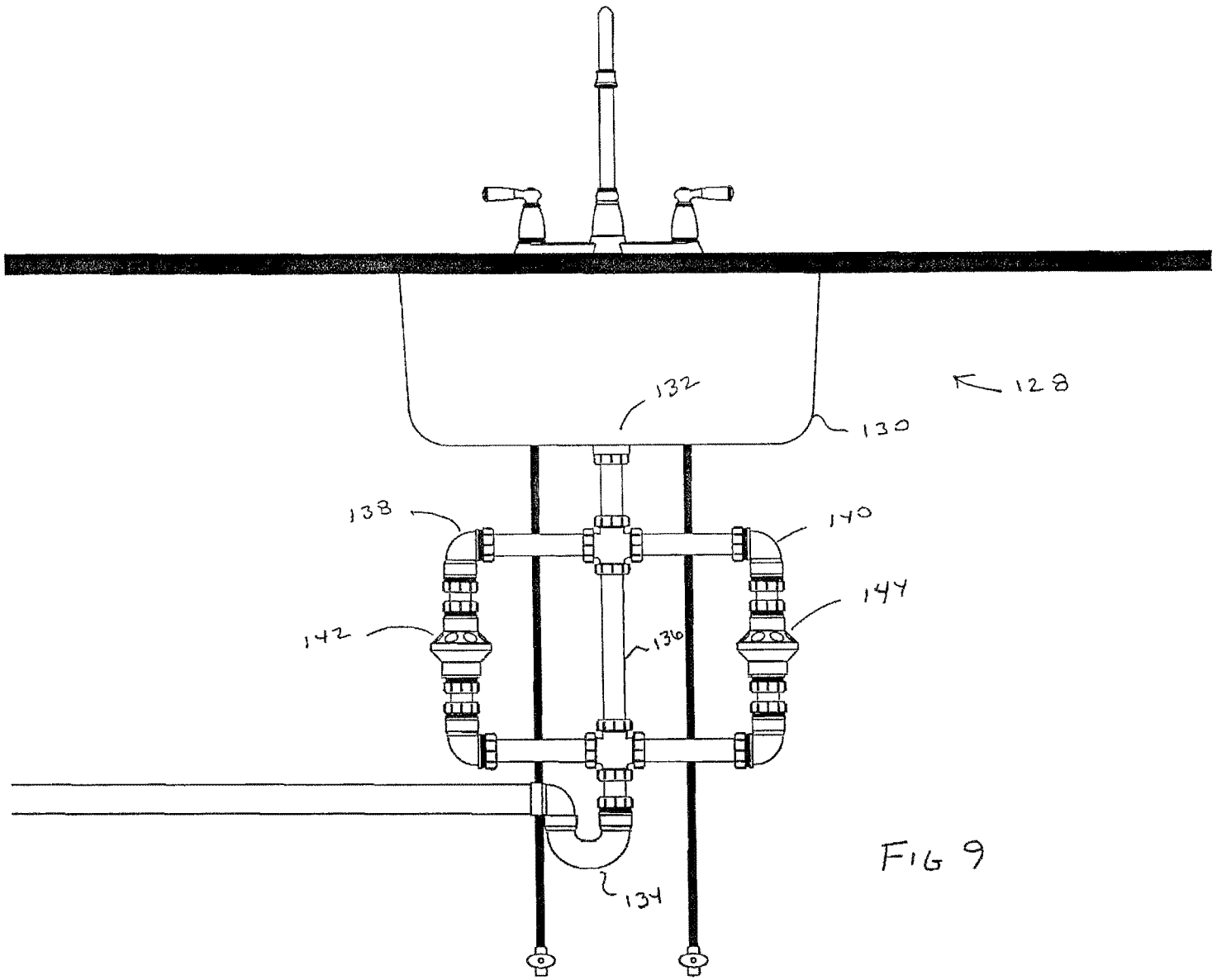
FIG. 9 is a schematic view of an alternative system arrangement with a pair of manifold fittings arranged in branch lines to a main drain line.

FIG. 9 shows a system 128, which is an alternative exemplary system to that shown in FIG. 7. A sink 130 includes a drain 132 that is fluidly connected to a liquid holding trap 134 through a central fluid path branch pipe 136. Cross-fitting connections from the central pipe 136 are made to a first branch 138 and second branch 140. Branch 138 includes a manifold fitting 142, while branch 140 includes a manifold fitting 144. As can be appreciated in this exemplary arrangement, the fluid stream drain connections of the various water discharge devices may be more conveniently connected to one of the fittings in the branches based on the lateral side relative to the central fluid path on which such devices are positioned. Further, in exemplary arrangements of this type, this approach may be utilized to maintain the manifold fittings 142, 144 and the fluid streams of liquid waste material that they receive, disposed away from the central pipe 136. This may be done to reduce the risk of fouling of the fluid stream drain outlets on the manifold heat exchange fittings by materials that might clog or foul them that may be passing through the fluid stream from the sink that passes through the central pipe 136. Alternatively, an approach of this type might also be taken to initially isolate the combined fluid streams of liquid waste material drained into one or both of the fittings 142, 144 from the material in the central pipe 136, while still enabling each of the fittings to be connected to atmosphere through the sink drain 132. This might be done for example to provide heat exchange with air and fluid streams in the heat exchange fitting on a branch fluid path and reduce the amount of initially hot water vapor from a sterilizer or other water discharge device that discharges hot water, migrating up into the sink through the sink drain. Of course these approaches are exemplary.

Figure 8:
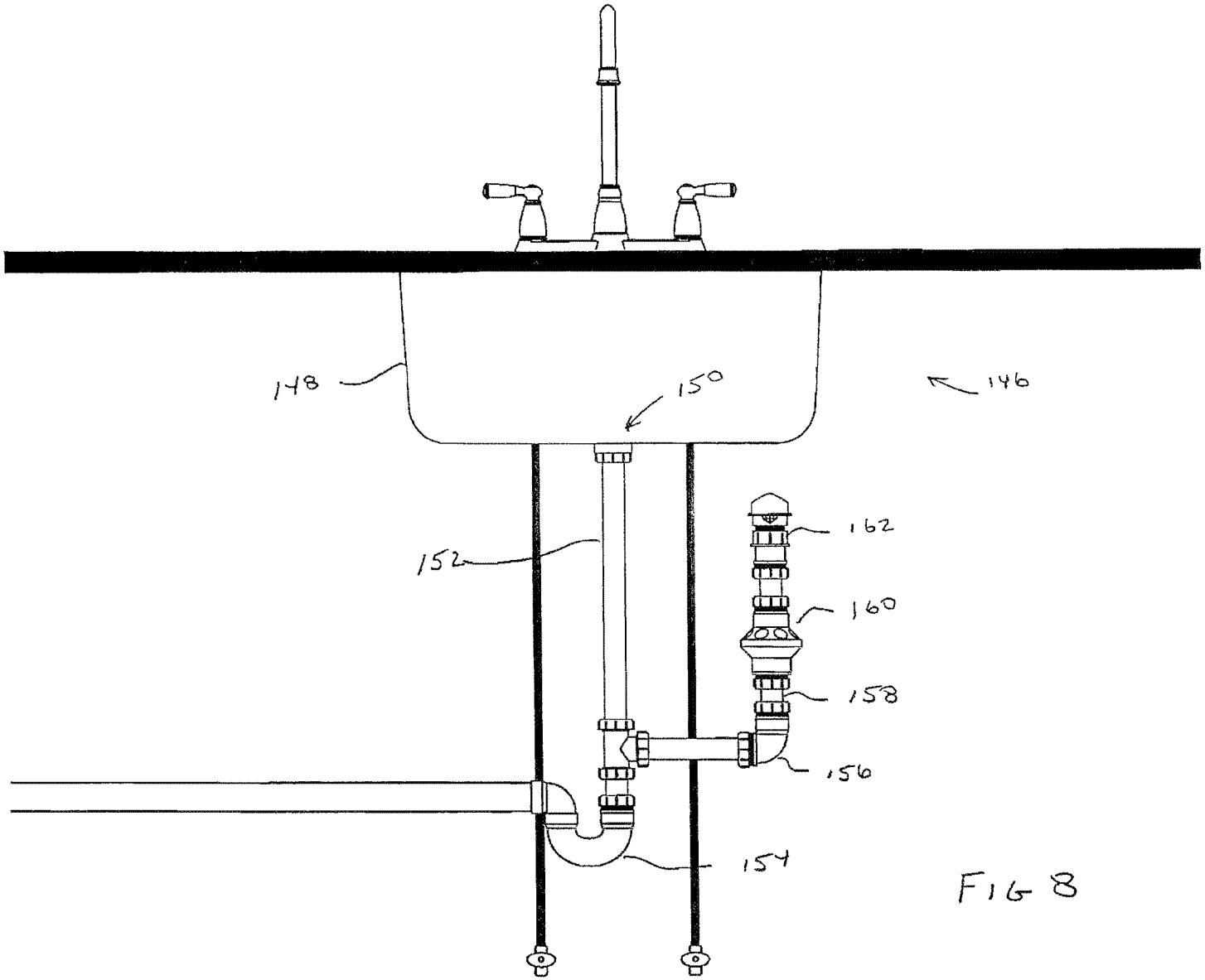
FIG. 8 is a schematic view of an alternative system arrangement with an exemplary manifold fitting arranged on a branch of a fluid drain pipe, with an air admittance/ball check valve in engagement with the fitting body inlet.

FIG. 8 shows yet another alternative system 146 that provides a fitting operable to receive fluid streams having fluids of different densities. System 146 includes a sink 148 with a drain 150, which is connected to a discharge pipe 152 that connects to a liquid holding trap 154. A branch 156 extends from the pipe 152 into a vertical stand pipe 158. An exemplary manifold heat exchange fitting 160 is connected to the stand pipe. An air admittance/check valve 162 is connected to the fitting inlet coupling portion of the body of the fitting 160. In the exemplary arrangement, the air admittance/check valve comprises a valve that allows a fluid stream of air to enter or be released from the top of the fitting body, but prevents liquid from escaping therefrom. This may be done through the use of a ball, a flap or other form of check valve structure in the valve.

As can be appreciated, in the exemplary system 146 this configuration enables the connections of the fluid streams from the water discharge devices to the branch 156 through connection to the fitting 160. This approach may be used for example to isolate the fluid path through the fitting 160 from the fluid path through the main drain pipe 152, while avoiding the need to connect the fitting inlet coupling portion to atmosphere through the sink drain 150. Of course, this approach is exemplary of configurations which may be utilized in connection with the exemplary manifold fittings to avoid the need to use the sink drain as the opening of the fluid connection interior area of the fitting body to atmosphere.

Figure 10:
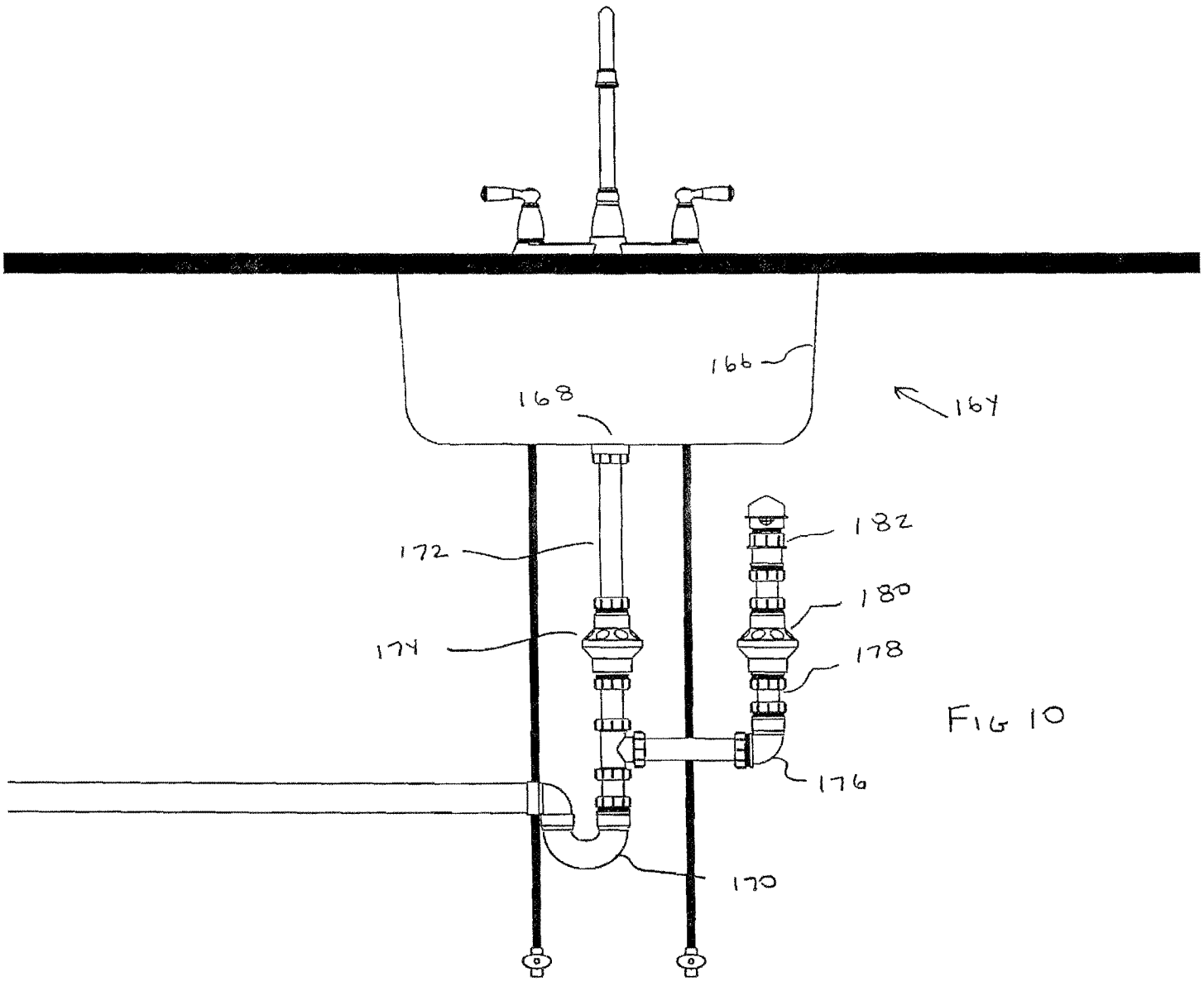
FIG. 10 is a schematic view of an alternative system arrangement similar to FIG. 8, except that a further manifold fitting is positioned in a main drain line.

FIG. 10 shows an alternative exemplary system 164 that is similar to FIG. 8. System 164 includes a sink 166 with a drain 168. The drain is connected to a liquid holding trap 170 through a fluid path that includes a central drain line 172. Positioned in the central drain line, which is made up of a plurality of pipe sections and fittings, is a manifold heat exchange fitting 174. Similar to the system shown in FIG. 8, the system 164 further includes a "T" branch line 176, which is connected to a vertical stand pipe 178. A manifold fitting 180 is positioned vertically above the stand pipe. An air admitting valve 182 is in fluid connection with the body inlet at the top of the fitting 180. As can be appreciated, the exemplary system 164 provides fluid stream drain connections for fluids having different densities via both the central drain line that extends directly between the sink drain 168 and the trap 170, as well as through the fitting 180 connected to the branch line 176.

Figure 11:
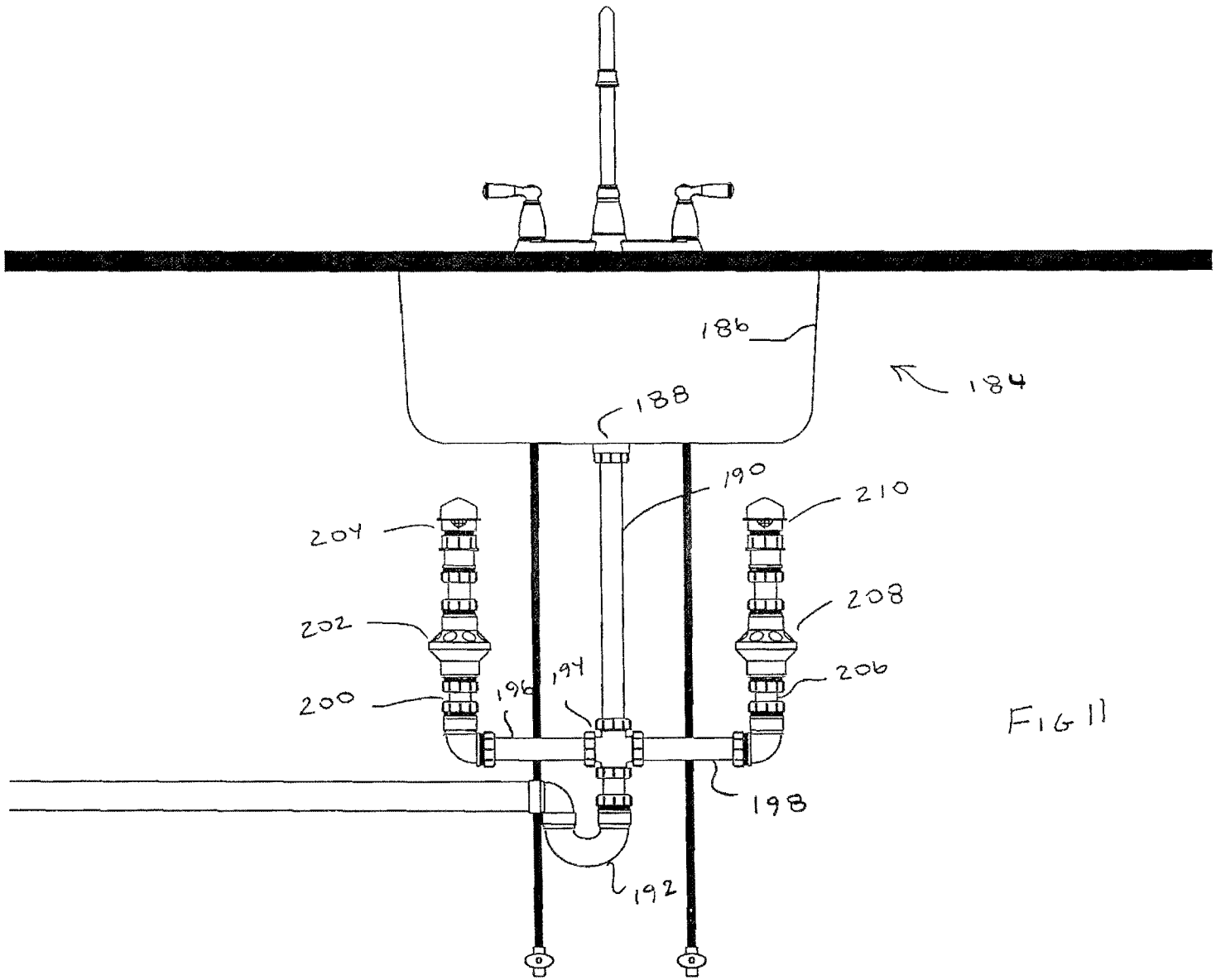
FIG. 11 is a schematic view of an alternative system arrangement similar to FIG. 8, but with a pair of manifold fittings in branch lines which extend from a main drain line, each of which branches includes an air admitting valve above the respective manifold fitting.

FIG. 11 shows yet another alternative exemplary system 184. System 184 includes a sink 186 with a drain 188. Drain 188 is connected through a central line 190 to a liquid holding trap 192. Line 190 includes a cross fitting 194, which connects to a first branch line 196 and a second branch line 198. Branch line 196 is connected to a stand pipe 200. A manifold fitting 202 is positioned in connection with the stand pipe 200 and an air admittance/check valve 204 is in connection with the fitting inlet coupling portion of the fitting 202. Similarly, branch line 198 is in connection with a stand pipe 206, which is in connection with a fitting outlet coupling portion of a fitting 208. Air admittance/check valve 210 is in fluid connection with the fitting inlet coupling portion of a fitting 208. As can be appreciated, these configurations avoid the need to connect the fluid collection interior areas of the fittings 202, 208 directly to the sink drain 188. This may be desirable in some applications. Further, the approach enables spacing the manifold fitting bodies and the associated fluid stream drain fitting connections away from the central line 190 from the sink drain, which may facilitate connecting the fittings to fluid streams from water discharge devices that may be more widely spaced apart within the facility where the system is located.

Figure 15:
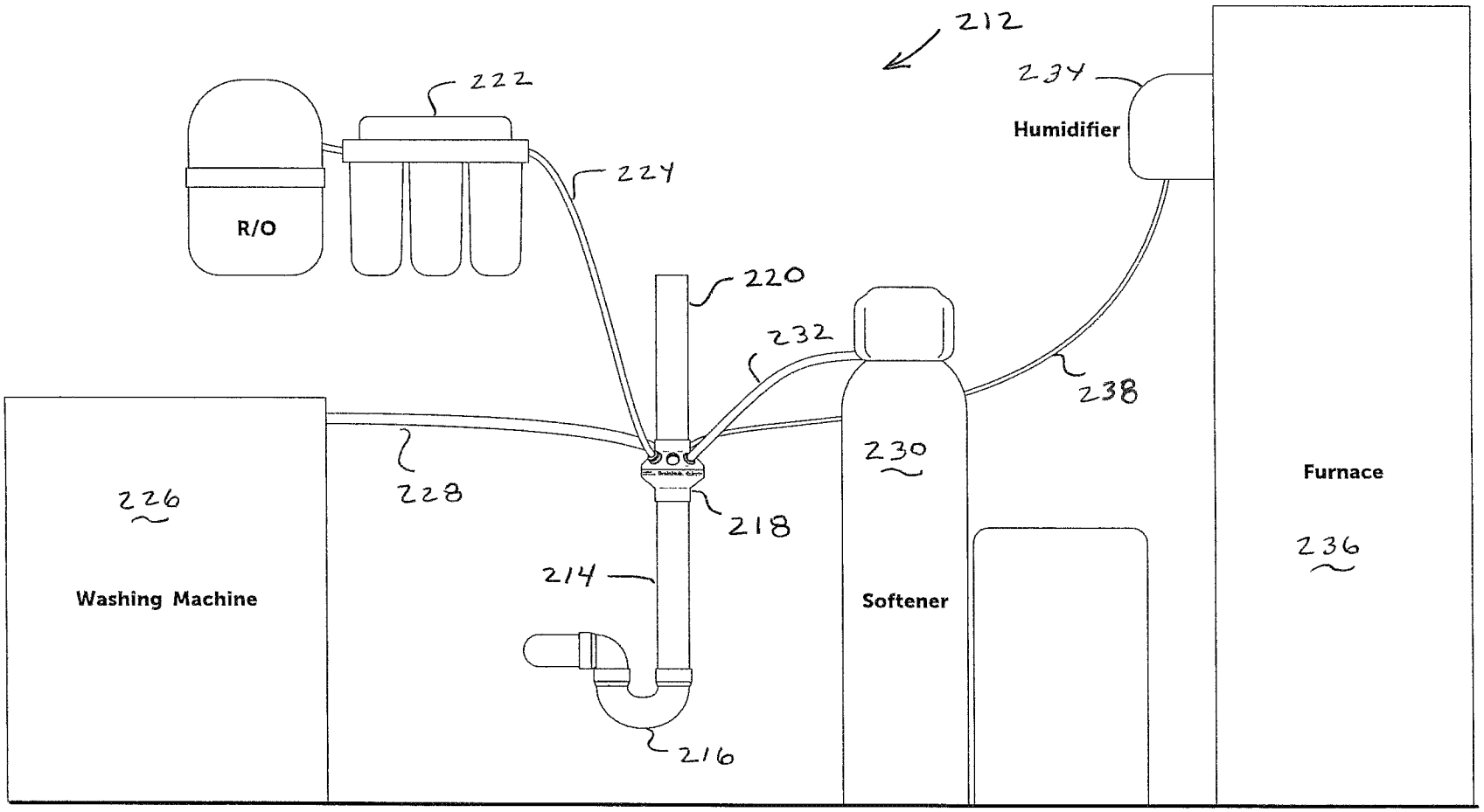
FIG. 15 is a schematic view of an exemplary arrangement for fluid discharge devices that discharge fluid streams at different fluid densities.

FIG. 15 shows yet another alternative exemplary system 212. A drain line 214 is connected to a liquid holding trap 216. The drain line is connected to a manifold heat exchange fitting 218 similar to those previously described. A stand pipe 220 extends upward from the top opening of the plumbing fitting 218.

A plurality of water discharge devices are connected to and discharge water fluid streams therefrom to the manifold fitting in this exemplary system. A filter 222 of the reverse osmosis type is fluidly connected through a drain line 224 to the manifold fitting 218. A cleaning/washing device 226 such as one used for cleaning instruments, utensils, tools, devices or other items is fluidly connected to the manifold fitting through a drain line 228.

A water treatment device 230, such as a water softener or water sterilizer is fluidly connected to manifold fitting 218 through a drain line 232. A humidifier 234, such as an air humidifier that treats air heated by a furnace 236 is fluidly connected to the manifold fitting 218 through a drain line 238. Other devices such as an air compressor, a refrigerator, an air conditioner, a steam trap, or a hot water tank pressure relief valve are other examples of devices that produce fluid streams that may be in communication with the fitting. Of course it should be understood that the described water discharge devices of system 212 are merely exemplary of devices from which the manifold fitting may receive discharged water or other fluid streams.

In the exemplary system 212 the stand pipe 220 is open to ambient air in the atmosphere and does not have a water drain line from a sink or similar drain above the stand pipe connected thereto. However, in other exemplary arrangements, one or more fluid streams such as water drain lines may be extended into an upper opening at the top of the stand pipe 220. For example, in some arrangements the stand pipe may be configured to receive an end of a relatively large drain hose or pipe therein compared to the size of the drain lines that connect directly to the body of the manifold fitting 218. Such a drain hose or pipe that discharges into the stand pipe may be from the water discharge device that discharges water at a high flow rate.

Alternatively, in other arrangements, the body inlet of the manifold fitting 218 may be connected to an air admittance/check valve like those previously described. Such a valve may operate to allow a fluid stream of air to flow into and out of the manifold fitting, while stopping any liquid discharge therefrom. Further in other exemplary systems the upper opening of the manifold fitting may be closed by a solid plug. Such a configuration may be appropriate based on the properties and types of water discharge devices to which the manifold fitting is connected.

Of course, it should be appreciated that these numerous different system configurations are exemplary. The system configurations that may be used in connection with the exemplary embodiments and numerous other configurations and arrangements may be utilized in connection with fittings having to be properties of that are discussed herein. Further, it should be appreciated that although in the exemplary embodiments the fitting structures have been used in connection with drains for water or other discarded liquids, fittings having the features described herein may be used for other functions and purposes that may be useful in providing different types of fluid conduit flows. Further while exemplary arrangements have been described in systems in which fluid streams of differing fluid densities are received in the fluid collection interior area of the fitting and heat exchange occurs within the interior area, other arrangements may include manifold fittings that receive fluid streams of fluids at similar densities that do not experience significant thermal exchange.

Although arrangements have been described herein based on certain exemplary embodiments, a wide array of modifications, variations and alternative constructions are also within the spirit and scope of the principles described herein. A number of arrangements for systems and manifold fittings have been described with reference to particular components, features, properties, attributes, relationships and methods. However, it should be understood that in other embodiments other arrangements may include other components, features, properties, attributes, relationships and/or methods which provide similar or other capabilities and functionalities.

It will also be readily understood that the features of exemplary embodiments as generally described and illustrated in the Figures can be arranged and designed in a wide array of different configurations. That is features, structures and/or characteristics of embodiments or arrangements described herein may be combined in any suitable manner in one or other embodiments or arrangements. Thus, the detailed description of the exemplary embodiments are of the apparatus, methods and articles as represented in the Figures. It is not intended to limit the scope of the embodiments as claimed, but are merely representative of selected exemplary embodiments that implement the principles described herein.

In the foregoing description, certain terms have been used to describe example arrangements for purposes of brevity, clarity and understanding. However, for example, certain terms, such as "upward," "downward," "higher," "lower," "left," "right," "outer," "inner," "front," "rear," "top," and "bottom" may have been used. However, no unnecessary limitations are to be implied therefrom, because such terms have been used for descriptive purposes and are intended to be broadly construed. Such terms shall not be construed as limitations on the scope of the claims hereof. Moreover, the descriptions and illustrations herein are by way of examples and the inventive teachings are not limited to the specific details that have been shown and described.

The exemplary structures and arrangements, along with the methods of preparing and using such structures and arrangements, achieve at least some desirable objectives, eliminate difficulties encountered in the use of prior devices and systems, solve problems and attain the desirable results described herein.

In the following claims, any feature described as a means for performing a function shall be construed as encompassing any means capable of performing the recited function and shall not be deemed limited to the particular means used for performing the function in the foregoing description or mere equivalence thereof.

Having described the features, discoveries and principles of the exemplary embodiments, the manner in which they are constructed and operated, and the advantages and useful results attained, the new and useful structures, devices, elements, arrangements, parts combinations, systems, equipment, operations, methods, processes and relationships are set forth in the appended claims.

I claim:

1. Apparatus comprising:

a water manifold fitting configured to receive a plurality of streams of water, wherein each of the streams is produced by a different device that delivers water to the fitting as a liquid or a mixture of liquid and vapor, wherein the fitting is configured to be positioned below a sink water drain from a sink and above a drain trap that receives the water from the sink water drain, wherein the fitting is configured to enable mixing and heat exchange between the plurality of streams and water received from the sink water drain, wherein the fitting comprises:

a body, wherein the body bounds a generally open fluid collection interior area, wherein in an operative position the interior area extends symmetrically about a vertical axis, a body inlet, wherein the body inlet is centrally axially located and is configured to enable receipt into the interior area through the body inlet of water from the sink water drain, a body outlet, wherein the body outlet is centrally axially located and is configured to enable water to pass out of the interior area through the body outlet and toward the drain trap, wherein the interior area extends continuously and annularly radially outward relative to the axis beyond the body inlet and the body outlet, wherein in the operative position of the fitting a lower axial end of the interior area is bounded within the body by an annular tapered wall surface that extends to the body outlet, wherein the annular tapered wall surface is configured such that in the operative position of the fitting the annularly tapered wall surface is radially increasingly closer to the axis with increased downward axial proximity to the body outlet, a plurality of drain fitting openings through the body, wherein each drain fitting opening, extends through the body to the interior area, in the operative position of the fitting is disposed in vertically overlying relation of the annular tapered wall surface, is configured to engage with either a respective drain fitting that delivers a respective fluid stream or a plug that closes the drain fitting opening.

2. The apparatus according to claim 1 wherein each of the plurality of drain fitting openings extends along a respective drain fitting axis, wherein in the operative position each drain fitting axis intersects with and extends at an acute angle to the vertical axis.

3. The apparatus according to claim 1 wherein each of the plurality of drain fitting openings extends along a respective drain fitting axis, wherein in the operative position each drain fitting axis intersects with and extends at an acute angle to the vertical axis and intersects with the body outlet.

4. The apparatus according to claim 1 wherein each of the plurality of drain fitting openings is disposed radially outward relative to the axis and radially outward beyond each of the body inlet and the body outlet.

5. The apparatus according to claim 1 wherein in the operative position the interior area is bounded by an upper axial end opposed of the lower axial end, wherein the plurality of drain fitting openings are open to the interior area at the upper axial end.

6. The apparatus according to claim 1 wherein in the operative position the interior area is bounded by an upper axial end opposed of the lower axial end, wherein each of the plurality of drain fitting openings are open to the interior area at the upper axial end, wherein in the operative position the upper axial end is bounded by a further annularly tapered wall surface, wherein the further annular tapered wall surface is coaxial with the axis, wherein in the operative position the further annularly tapered wall surface extends radially further away from the axis and the body inlet with increased proximity to the body outlet, wherein the plurality of drain fitting openings extend in the further annularly tapered wall surface, wherein each of the plurality of drain fitting openings extends along a respective drain fitting axis, wherein in the operative position each drain fitting axis extends that an acute angle to the vertical axis.

7. The apparatus according to claim 1 wherein in the operative position the interior area is bounded by an upper axial end opposed of the lower axial end, wherein each of the plurality of drain fitting openings are open to the interior area at the upper axial end, wherein in the operative position the upper axial end is bounded by a further annularly tapered wall surface, wherein the further annular tapered wall surface is coaxial with the axis, wherein in the operative position the further annularly tapered wall surface extends radially further away from the axis and the body inlet with increased proximity to the body outlet, wherein the plurality of drain fitting openings extend in the further annularly tapered wall surface, wherein the interior area is radially bounded by a cylindrical surface that in the operative position extends continuously vertically parallel to the axis intermediate of the annularly tapered wall surface and the further annularly tapered wall surface.

8. The apparatus according to claim 1 wherein in the operative position the interior area is bounded by an upper axial end opposed of the lower axial end, wherein each of the plurality of drain fitting openings are open to the interior area at the upper axial end, wherein in the operative position the upper axial end is bounded by a further annularly tapered wall surface, wherein the further annularly tapered wall surface is coaxial with the axis, wherein in the operative position the further annularly tapered wall surface extends radially further away from the axis and the body inlet with increased proximity to the body outlet, wherein the plurality of drain fitting openings extend in the further annularly tapered wall surface, wherein the interior area is radially bounded by a cylindrical surface that in the operative position extends continuously vertically parallel to the axis intermediate of the annularly tapered wall surface and the further annularly tapered wall surface, and wherein in the operative position no body structures are positioned within the interior area radially inward of the cylindrical surface.

9. The apparatus according to claim 1 wherein in the operative position the interior area is bounded by an upper axial end opposed of the lower axial end, wherein each of the plurality of drain fitting openings are open to the interior area at the upper axial end, wherein in the operative position the upper axial end is bounded by a further annularly tapered wall surface, wherein the further annularly tapered wall surface is coaxial with the axis, wherein in the operative position the further annularly tapered wall surface extends radially further away from the axis and the body inlet with increased proximity to the body outlet, wherein the body further includes a tapered annular outer wall surface, wherein the tapered annular outer wall surface outwardly overlies the further annularly tapered wall surface, wherein in the operative position the tapered annular outer wall surface is tapered so as to extend further radially away from the axis and the body inlet with increased proximity to the body outlet, wherein each of the plurality of drain fitting openings extend in the further annular tapered wall surface and the tapered annular outer wall surface.

10. The apparatus according to claim 1 wherein in the operative position the interior area is bounded by an upper axial end opposed of the lower axial end, wherein each of the plurality of drain fitting openings are open to the interior area at the upper axial end, wherein in the operative position the upper axial end is bounded by a further annularly tapered wall surface, wherein the further annularly tapered wall surface is coaxial with the axis, wherein in the operative position the further annularly tapered wall surface extends radially further away from the axis and the body inlet with increased proximity to the body outlet, wherein the body further includes a tapered annular outer wall surface, wherein the tapered annular outer wall surface outwardly overlies the further annularly tapered wall surface, wherein in the operation position the tapered annular outer wall surface is tapered so as to extend further radially away from the axis and the body inlet with increased proximity to the body outlet, wherein each of the plurality of drain fitting openings extend in the further annularly tapered wall surface and the tapered annular outer wall surface, wherein each of the plurality of drain fitting openings extends along a respective drain fitting axis, wherein each respective drain fitting axis extends at a common acute angle to the vertical axis.

11. The apparatus according to claim 1 wherein in the operative position the interior area is bounded by an upper axial end opposed of the lower axial end, wherein each of the plurality of drain fitting openings are open to the interior area at the upper axial end, wherein in the operative position the upper axial end is bounded by a further annularly tapered wall surface, wherein the further annularly tapered wall surface is coaxial with the axis, wherein in the operative position the further annularly tapered wall surface extends radially further away from the axis and the body inlet with increased proximity to the body outlet, wherein the body further includes a tapered annular outer wall surface, wherein the tapered annular outer wall surface outwardly overlies the further annularly tapered wall surface, wherein in the operative position the tapered annular outer wall surface is tapered so as to extend further radially away from the axis and the body inlet with increased proximity to the body outlet, wherein the plurality of drain fitting openings are uniformly angularly spaced on the tapered annular outer wall surface, wherein each of the plurality of drain fitting openings extend in the further annularly tapered wall surface and the tapered annular outer wall surface, wherein each of the plurality of drain fitting openings extends along a respective drain fitting axis, wherein each respective drain fitting axis intersects the body outlet and extends at a common acute angle to the vertical axis.

12. The apparatus according to claim 1 wherein the body includes a fitting inlet coupling portion, wherein the fitting inlet coupling portion is in fluid connection through the body with the body inlet, wherein the fitting inlet coupling portion is configured to receive water from the sink water drain positioned in directly vertically overlying relation of the fitting inlet coupling portion.

13. The apparatus according to claim 1 wherein the body includes a fitting outlet coupling portion, wherein the fitting outlet coupling portion is in fluid connection through the body with the body outlet, wherein the fitting outlet coupling portion is configured to deliver water from the fitting outlet coupling portion to the drain trap positioned in directly vertically underlying relation of the fitting outlet coupling portion.

14. The apparatus according to claim 1 wherein the body includes a fitting inlet coupling portion, wherein the fitting inlet coupling portion is in fluid connection through the body with the body inlet, wherein the body further includes a fitting outlet coupling portion, wherein the fitting outlet coupling portion is in fluid connection through the body with the body outlet, wherein the fitting outlet coupling portion is configured to deliver water from the fitting outlet coupling portion to a further fitting inlet coupling portion of a further water manifold fitting of a same configuration positioned in immediately adjacent directly vertically underlying relation of the fitting outlet coupling portion.

15. The apparatus according to claim 1 wherein each of the plurality of drain fitting openings is configured to be respectively fluidly engaged with either a rigid tube or a flexible tube as well as closed by the plug.

16. The apparatus according to claim 1 wherein the body includes a fitting inlet coupling portion, wherein the fitting inlet coupling portion is in fluid connection through the body with the body inlet, wherein the fitting inlet coupling portion is configured to fluidly engage either a pipe that delivers water from the sink water drain in directly vertically overlying relation of the fitting inlet coupling portion or an air admittance/check valve.

17. Apparatus comprising:

a water manifold fitting configured to receive a plurality of streams of material containing water, wherein each of the streams is produced by a different device that delivers the stream to the fitting as a liquid or a mixture of liquid and vapor, wherein the fitting is configured to be positioned below a sink water drain from a sink, and above a drain trap that receives water from the sink water drain, wherein the fitting is configured to enable mixing and heat exchange between the plurality of streams and water received from the sink water drain, wherein the fitting comprises:

a body, wherein the body bounds a fluid collection interior area, wherein the interior area extends symmetrically about a central axis, a body inlet, wherein the body inlet extends coaxial with the central axis and is configured to fluidly connected to the sink water drain and to enable air and water to enter the interior area, a body outlet, wherein the body outlet extends coaxial with the central axis and is configured to enable liquid including water to pass out of the interior area toward the drain trap, wherein the interior area extends annularly and continuously radially outward relative to the central axis beyond the body inlet and the body outlet, wherein an axial end of the interior area is bounded within the body by an annular tapered wall surface that extends to the body outlet, wherein the annular tapered wall surface is coaxial with the central axis and is configured so that the annularly tapered wall surface is radially increasingly closer to the central axis with increasing axial proximity to the body outlet, a plurality of drain fitting openings each configured to receive a respective fluid stream, wherein each fitting opening extends through the body along a drain fitting axis and is open to the interior area, wherein each drain fitting axis intersects with the central axis at an acute angle, wherein each respective drain fitting opening is configured to engage either a fluid fitting that delivers a respective of fluid stream or a plug that closes the drain fitting opening.

18. The apparatus according to claim 17 wherein in the operative position the central axis extends vertically, and wherein each respective drain fitting opening vertically overlies the annular tapered wall surface.

19. The apparatus point of claim 17 wherein the each drain fitting axis intersects with the central axis within the body outlet.

20. The apparatus according to claim 17 wherein a further axial end of the interior area opposed of the axial end is bounded within the body by a further annular tapered wall surface, wherein the further annular tapered wall surface is coaxial with the central axis, extends radially outward from the body inlet and is radially further away from the central axis with increased axial proximity to the body outlet, wherein each of the plurality of drain fitting openings extends through the further annular tapered wall surface.

21. The apparatus according to claim 17 wherein a further axial end of the interior area opposed of the axial end is bounded within the body by a further annular tapered wall surface, wherein the further annular tapered wall surface is coaxial with the central axis, extends radially outward from the body inlet and is radially further away from the central axis with increased axial proximity to the body outlet, wherein each of the plurality of drain fitting openings extends through the further annular tapered wall surface, wherein axially intermediate of the annular tapered wall surface and the further annular tapered wall surface the interior area is radially outwardly bounded by a cylindrical wall surface that continuously extends parallel to the central axis.

22. The apparatus according to claim 17 wherein a further axial end of the interior area opposed of the axial end is bounded within the body by a further annular tapered wall surface, wherein the further annular tapered wall surface is coaxial with the central axis, extends radially outward from the body inlet and is radially further away from the central axis with increased axial proximity to the body outlet, wherein the body is outwardly bounded by an outer tapered wall surface that extends in overlying relation of the further annular tapered wall surface, wherein the outer tapered wall surface extends further radially outward away from the body inlet with increased axial proximity to the body outlet, wherein each of the plurality of drain fitting openings extend through the outer tapered wall surface and the further annular tapered wall surface along the respective drain fitting axis.

23. The apparatus according to claim 17 wherein a further axial end of the interior area opposed of the axial end is bounded within the body by a further annular tapered wall surface, wherein the further annular tapered wall surface is coaxial with the central axis, extends radially outward from the body inlet and is radially further away from the central axis with increased axial proximity to the body outlet, wherein the body is outwardly bounded by an outer tapered wall surface that extends in overlying relation of the further annular tapered wall surface, wherein the outer tapered wall surface extends further radially outward away from the body inlet with increased axial proximity to the body outlet, wherein each of the plurality of drain fitting openings extends through the outer tapered wall surface and the further annular tapered wall surface along the respective drain fitting axis which intersects with the body outlet.

24. The apparatus according to claim 17 wherein the body includes a fitting inlet coupling portion, wherein the fitting inlet coupling portion is coaxial with and in fluid communication through the body with the body inlet, wherein the fitting inlet coupling portion is configured to fluidly engage either a pipe that delivers water from the sink water drain in directly vertically overlying relation of the fitting inlet coupling portion or an air admittance/check valve.

* * * * *